United States Patent [19]

Everett et al.

[11] 4,193,394

[45] Mar. 18, 1980

[54] BACK WALKER AND MASSAGE DEVICE

[76] Inventors: Billy Everett, c/o George Spector, 3615 Woolworth Bldg., 233 Broadway; George Spector, 3615 Woolworth Bldg., 233 Broadway, both of, New York, N.Y. 10007

[21] Appl. No.: 935,019

[22] Filed: Aug. 18, 1978

[51] Int. Cl.[2] ..... A61H 15/00

[52] U.S. Cl. ..... 128/57; 272/116; 272/117; 272/134

[58] Field of Search ..... 128/57, 24.3, 25 R; 272/116

[56] References Cited

U.S. PATENT DOCUMENTS

| | | | |
|---|---|---|---|
| 1,098,327 | 5/1914 | Koch | 128/57 |
| 1,748,425 | 2/1930 | Odell | 128/57 |
| 2,377,131 | 5/1945 | Conrad | 128/57 |
| 2,438,249 | 3/1948 | Mattison | 128/57 |

*Primary Examiner*—Lawrence W. Trapp

[57] ABSTRACT

An exercising apparatus which additionally serves as a massager the device including a stand, roller rack and crank that readily assemble together in various ways so that a person placed in different positions thereupon, can exercise or massage certain areas of his body.

5 Claims, 4 Drawing Figures

BACK WALKER AND MASSAGE DEVICE

This invention relates to exercising apparatus.

A principal object of the present invention is to provide an exerciser that can be used in a variety of ways so that a person can exercise different portions of his body, as wished.

Another object is to provide an exerciser that more particularly serves as a massager, especially for a persons back which is slided over a set of rollers of the device so that it can be stated as "walking" on the rollers.

Another object is to provide a back walker upon which a person can lie facing downward so the rollers excerise and strengthen the stomach muscles for reducing purposes and attaining a slim appearance.

Yet a further object is to provide a back walker in which the rollers are movable respective to each other during use, and additionally may have been set closer or further apart so that a person can concentrate a greater massaging effect at selected portions of his body.

Another object is to provide a back walker which is made of several components so, when dismantled, it fits in a small storage place, and which can be assembled in different ways for different exercise uses.

Figure 1:
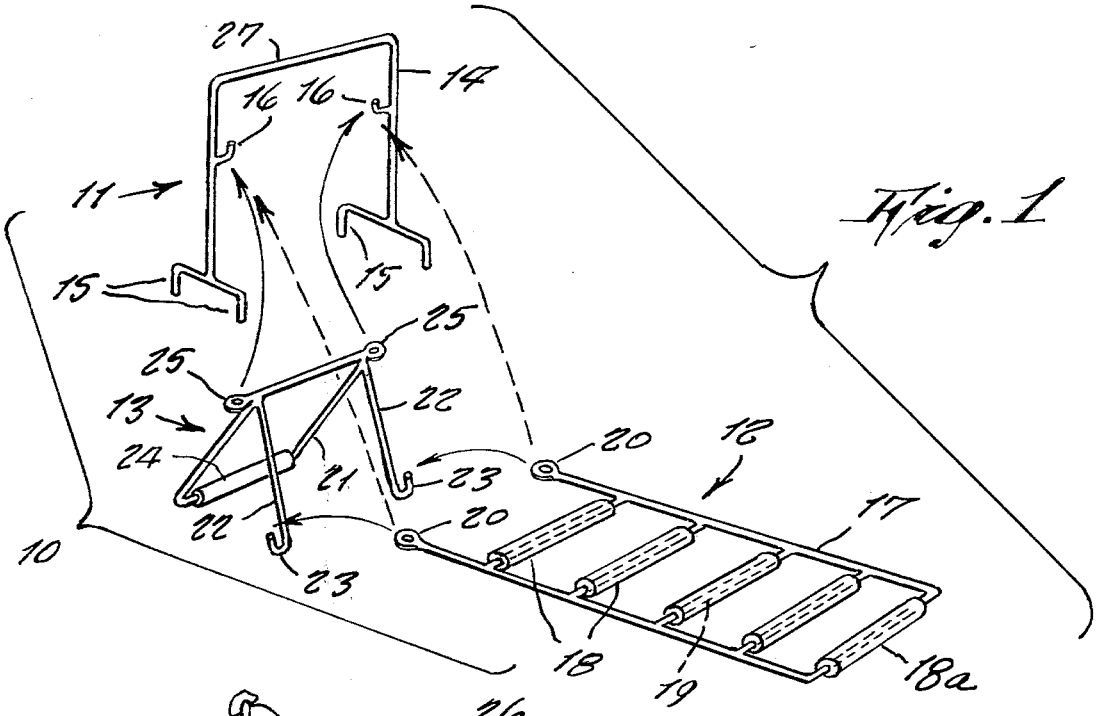
FIG. 1 is a perspective view of the invention components including a stand, swing and roller rack, which are here shown detached from each other.
Figure 2:
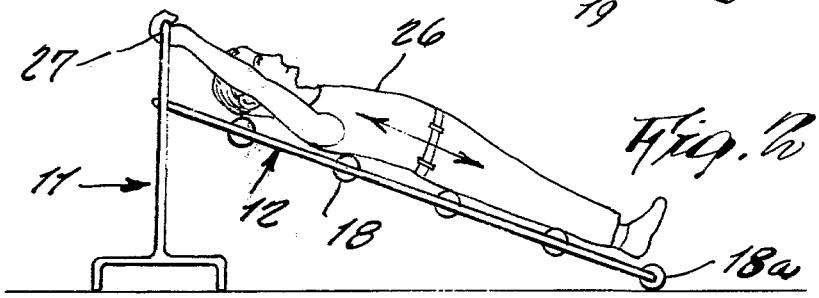
FIG. 2 illustrates the stand and rack assembled, and showing a person laying down on it facing downward.
Figure 3:
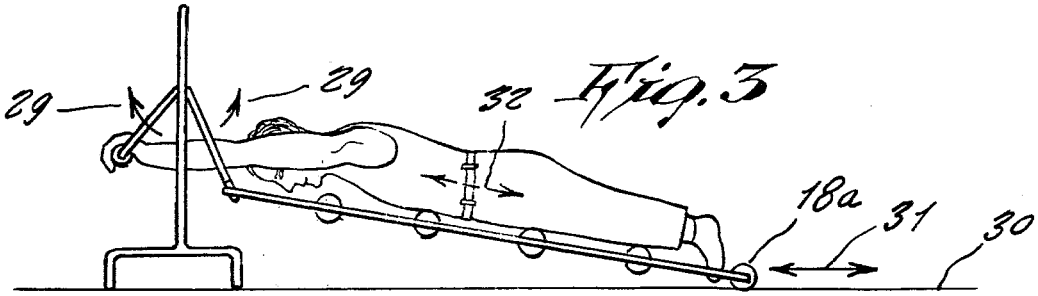
FIG. 3 illustrates the stand, swing and rack assembled and showing a person laying down on it facing upward.

Referring now to the drawing in greater detail, and more particularly to FIGS. 1, 2 and 3 at this time, the reference numeral 10 represents a back walker according to the present invention wherein there is a stand 11, a roller rack 12 and a crank 13 which are variously or selectively assembled together as shown in FIGS. 2 and 3.

The stand includes inverted, U-shaped pipe frame 14 upon feet 15, hooks 16 serve for attachment to either the rack or the crank.

The rack includes a ladder shaped, piper frame 17 the carries rotatable rollers 18 fitted on ball bearings mounted on the parallel spaced apart bars 19. Eyelets 20 at one end of the frame are provided for engaging the hooks 16.

The crank includes a rectangular frame 21 made of pipe integral with angularly extending bars 22 bent at their ends into hooks 23. One side of the frame 21 carries a freely rotatable handle 24. Eyelets 25 serve to engage the hooks 16.

In use, as shown in FIG. 2, the stand and rack alone are assembled, so a person 26 can lay with his back on the rollers 18 in an inclined position, and by grasping the top horizontal bar 27 of the frame 14 with his hands can pull himself to slide reciprocally upon the rollers as shown by double-headed arrow 28, in order to massage his back.

In FIG. 3, the stand, rack and crank are all assembled so a person can lay on the rack with stomach down on the rollers 18. The rack is supported from the crank which is supported from the stand so that by swinging the crank, as shown by arrows 29, the rack can slide on a floor 30, due to an endmost roller 18 a resting thereupon so to travel as shown by double-headed arrow 31. Additionally the person can slide on the rollers 18 as shown by double-headed arrow 32 so to exercise the abdomen.

Figure 4:
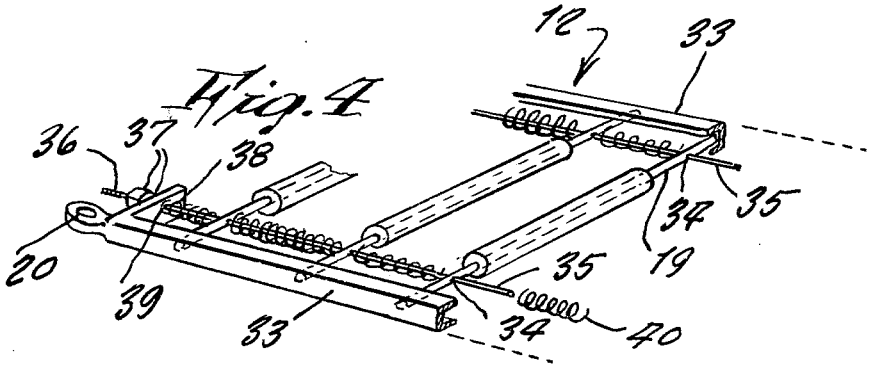
FIG. 4 illustrates a portion of a modified design of rack in which the rollers are additionally slidable further or closer apart from each other, as a laying person slides upon the rollers and which is caused by selectively fitted stronger or weaker springs between the rollers the variations of roller positions causing greater massaging actions at different desired portions of the body.

In a modified design shown in FIG. 4, the rack frame includes opposite side bars 33 made of channel iron so that ends of bars 19 are slidable therein. A transverse opening 34 near each end of each bar 19 slidably receives a straight rod 35 which has screw thread 36 at one end for receiving nuts 37 so to rigidly secure the the rod 35 to a cross arm 38 at one end of the rack and which includes a threaded opening 39 engaging the rod 35. Compression springs 40 of various lengths can be selectively placed between the bars 19, around the rods 35 so to space the distances between the rollers, as wished.

During exercises the rollers can than be grouped as wished, and the rollers slide respective to each other so that the distances therebetween changes as the springs compress and expand.

What is claimed is:

1. A back walker, comprising in combination, a stand, a roller rack and a crank, said rack selectively being supported either directly from said stand or from said crank which is supported on said stand, and said rack including a plurality of parallel, spaced-apart rollers rotatable on bearings on bars slidable on channels of said rack, and spring means allowing change of distances between said rollers during an exercise.

2. The combination as set forth in claim 1 wherein said stand comprises an inverted U-shaped pipe frame upon feet, and hooks on said frame selectively engaging eyelets on said rack and on said crank.

3. The combination as set forth in claim 2 wherein said rack is ladder-shaped and one endmost of said roller bars is fixedly secured to said frame so that an endmost roller thereof engages a floor when one end of said rack rests thereupon.

4. The combination as set forth in claim 3 wheren said crank comprises a rectangular pipe frame integral with angular bars hooked on there ends, and a rotatable handle on one side of said frame.

5. The combination as set forth in claim 4 wherein said rack roller bars, with exception of said endmost roller bar, each includes a transverse opening near each end thereof, a straight rod extending through said openings and being affixed removably at one end to said rack, and said spring means comprising compression coil springs of various length around said rods between said roller bars.

* * * * *